United States Patent [19]

Gibbons et al.

[11] Patent Number: 4,611,771

[45] Date of Patent: Sep. 16, 1986

[54] FIBER OPTIC TRACK/REAIM SYSTEM

[75] Inventors: John P. Gibbons; Rex B. Powell, both of Huntsville, Ala.

[73] Assignee: United States of America as represented by the Secretary of the Army, Washington, D.C.

[21] Appl. No.: 724,432

[22] Filed: Apr. 18, 1985

[51] Int. Cl.[4] ..... F41G 7/32

[52] U.S. Cl. ..... 244/3.12; 244/3.11

[58] Field of Search ..... 244/3.12, 3.11

[56] References Cited

U.S. PATENT DOCUMENTS

| | | | |
|---|---|---|---|
| 3,724,783 | 4/1973 | Nolan, Jr. et al. | 244/3.15 |
| 4,047,678 | 9/1977 | Miller et al. | 244/3.16 |
| 4,123,017 | 10/1978 | Lewis et al. | 244/3.16 |
| 4,185,796 | 1/1980 | Riley | 244/3.12 |
| 4,198,015 | 4/1980 | Yates et al. | 244/3.15 |

FOREIGN PATENT DOCUMENTS

| | | | |
|---|---|---|---|
| 1467552 | 3/1977 | United Kingdom | 244/3.12 |

OTHER PUBLICATIONS

*Army Research, Development & Acquisition Magazine;* "A Glimpse at Fog-M"; p. 3; Jan.-Feb. 1984.

*Primary Examiner*—Charles T. Jordan

*Attorney, Agent, or Firm*—Anthony T. Lane; Robert P. Gibson; Freddie M. Bush

[57] ABSTRACT

In a missile tracking and guidance system, a fiber optic link is maintained between a missile and the launcher. Tracking after launch is via a video link between the missile seeker and a video imager at the launcher. Guidance signals are derived from the video signal input to the imager and transmitted back to the missile. Additionally, rate sensors and an interrupt or reaim circuit within the launcher allows an operator to reacquire the target for refining the missile seeker look axis toward a target during flight. After the target aimpoint is refined the operator can then release the interrupt circuit, allowing the system to continue tracking from the video input, with a newly established seeker heading established during the aimpoint refinement.

9 Claims, 6 Drawing Figures

FIBER OPTIC TRACK/REAIM SYSTEM

DEDICATORY CLAUSE

The invention described herein may be manufactured, used, and licensed by or for the Government for governmental purposes without the payment to us of any royalties thereon.

BACKGROUND OF THE INVENTION

Command-to-line-of-sight (CLOS) systems such as a laser beamrider have the disadvantages of requiring the gunner to be exposed during the missile flight and of depending on the gunner's ability to maintain LOS between the tracker optics cross-hairs and the target within a foot or so with a handheld launcher under stressful battlefield conditions.

Fire-and-Forget systems such as inertially guided or two-color infrared (IR) systems have the advantage that the gunner can take cover as soon as the missile is locked on and launched. They are sensitive, however, to conditions which cause temporary obscuration (artificial or natural) of the target during flight. In addition, limited target image resolution at launch (for maximum range targets) and/or a change in the approach angle during flight may cause the impact point to be less than optimum. If a correlation tracker is used, aimpoint drift during flight is also a problem.

SUMMARY OF THE INVENTION

Fiber optic guidance methods for a missile system allows tracking after launch through the eyes (or seeker) of the missile via a fiber optic link with the missile and also reacquisition of control of the missile for flight path change or correction during any stage of flight.

The fiber optic track/reaim system, like a fire-and-forget system, permits the gunner to take cover immediately after missile launch. Additionally, rate sensors and an interrupt switch in the launcher give the gunner the option of reacquiring the target in the event of temporary obscuration and/or of refining the final target aimpoint after range closure has improved resolution.

The gunner normally locks on to the target before launch just as with other fire-and-forget systems that have no ground link. The fiber optic link however, allows the gunner to refine tha aimpoint later. This allows use of lower resolution seekers since the gunner initially needs only to lock on to the target area. (The gunner uses a separate sight to view the target prior to launch.) It also gives the gunner counter-counter-measure capability as well as the capability to select a particular point on the target.

This system, utilizing a special hand-held launcher, allows the gunner complete freedom of movement, such as to take cover, immediately after launch. Should the gunner later activate the reaim phase, the position of the tracker crosshairs is controlled using information derived from the launcher angular rate sensors and subsequent angular motions of the launcher. To the gunner, it is similar to aiming a rifle except that the actual initial position and orientation of the launcher, relative to the target when the reaim phase starts, have no effect.

DESCRIPTION OF THE PREFERRED EMBODIMENT

Figure 1:
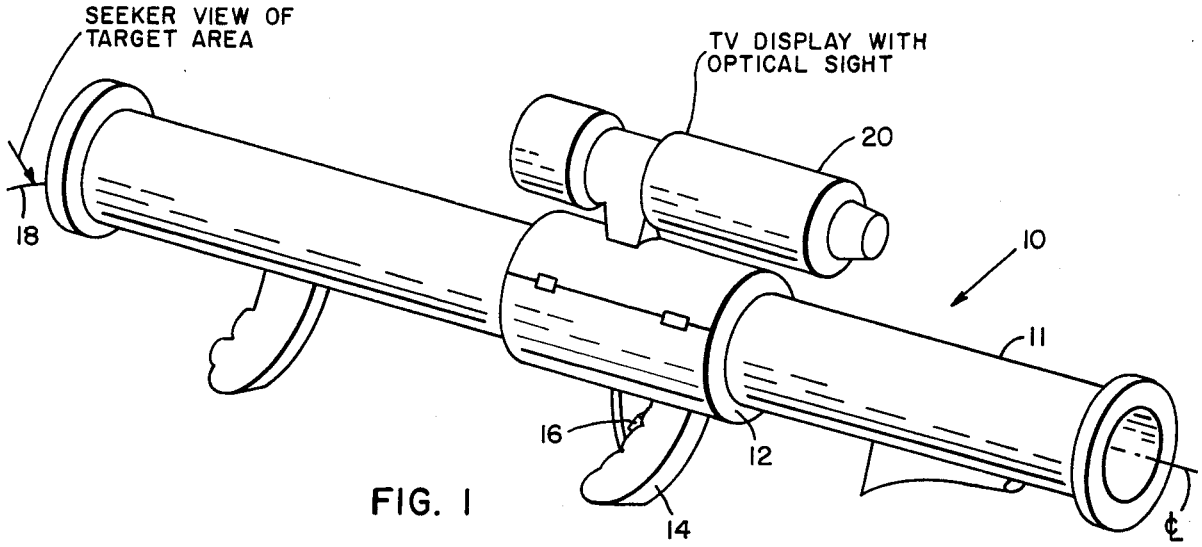
FIG. 1 is a diagrammatic view of a preferred embodiment of a fiber optic launcher system.

Referring now to the drawings, like numbers refer to like parts in the respective figures. FIG. 1 shows a typical fiber optic launcher wherein the launcher 10 has a cylindrical sleeve portion 12 therearound which contains the angular rate sensor circuitry and tracking circuitry for the launcher. A pistol-grip 14 protrudes from the launcher tube 11 through sleeve 12 and supports trigger 16 which functions as an interrupt or reaim switch when depressed subsequent to missile launch. A separate trigger (not shown) is used to initiate the missile launch sequence and may also be mounted on pistol-grip 14 or adjacent thereto. After launch of a missile (not shown) an optical fiber is payed out behind the missile and is coupled to the launcher providing a seeker image of the target area from the missile back to the launcher. This seeker image is coupled into a combined TV display and optical sight 20 mounted on the launch tube 11 so that an operator can view the seeker image through the TV display on the launch tube even though the launcher is no longer at the launch site.

Figure 2:
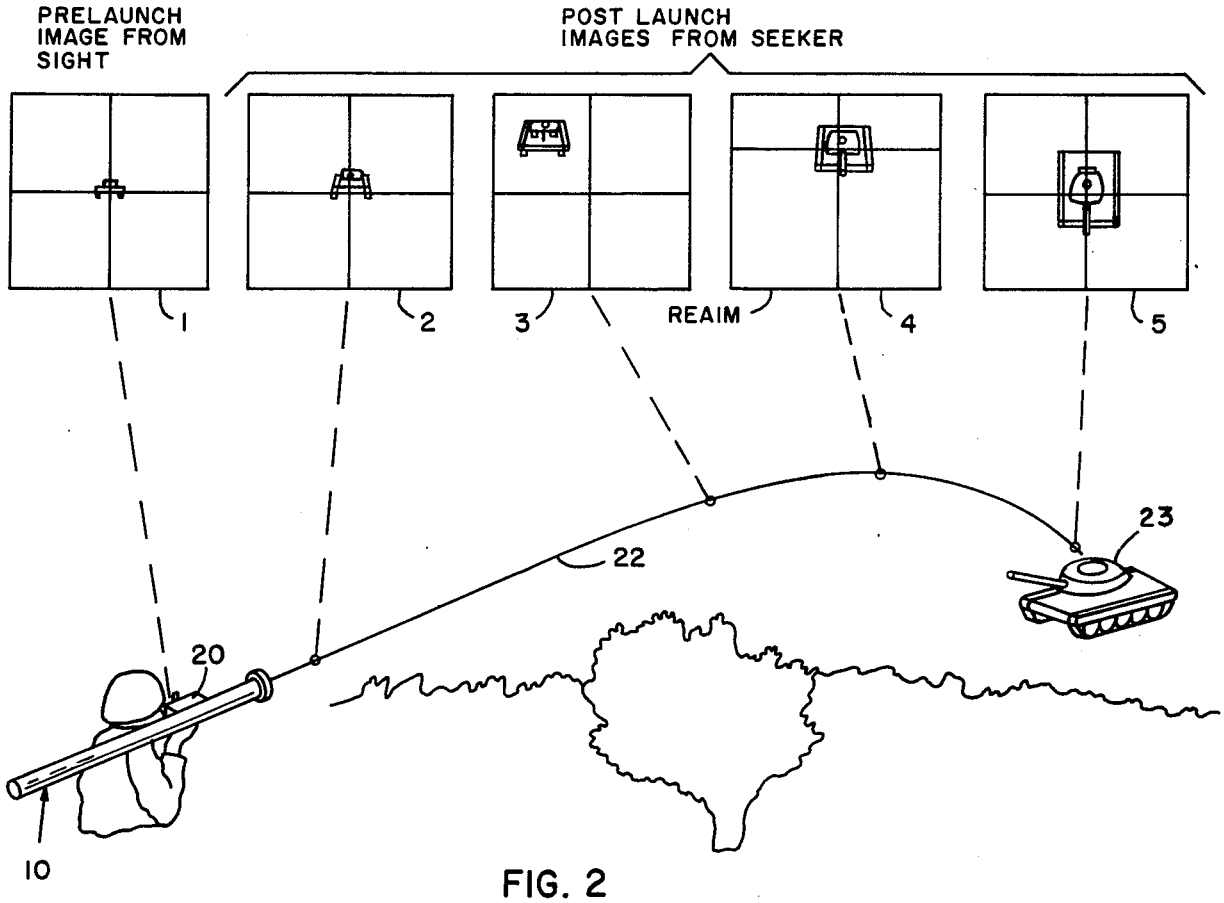
FIG. 2 is an operational sequence diagram of the fiber optic system, showing typical target images at various points on the trajectory path.

FIG. 2 shows a typical operational sequence in its primary mode of use, lock-on-before-launch, wherein the target is actually visible in the line-of-sight (LOS). The gunner or operator observes the target by way of a television (TV) display which is part of optics package 20. Images 1–5 are shown with dashed lines, coupled to respective points along the trajectory path 22 between the launcher 10 and the target 23, to indicate a typical image at each point. Prior to missile launch, the TV of optics package 20 displays the target as seen through an optical sight such as a low-power optical telescope or a thermal weapon sight as shown typically in Image 1 of FIG. 2. Upon launch, the TV display switches to the missile seeker, viewing the scene as it is seen by the missile seeker and transmitted back on the fiber optic data link, as shown in Image 2. The tracking and missile guidance are automatic and the gunner may take cover (etc.) as he pleases. For fire-and-forget operation, it can happen that as the missile approaches the target and its resolution improves, the crosshairs are no longer locked on the desired aimpoint as shown in Image 3. This can be caused by temporary obscuration of the target during flight, lack of target resolution in the seeker at launch, presence of a nearby, more sharply contrasting object in the background at launch, tracker drift or change in the target approach, aspect. In any case, the gunner depresses switch 16 (shown in FIG. 1) on the electronics package attached to the launcher. This breaks the track loop and allows the gunner to move the crosshairs to the desired aimpoint, Image 4. The switch is then released and the missile homes in on the new aimpoint, Image 5. This function can be done no matter where the gunner is concealed, because the optic system crosshairs position is changed with respect to the video image only when the switch is depressed and angular motion of the launcher is sensed. This occurs because the rate sensors contained in the launcher package do not sense the initial launcher orientation. Their outputs begin being integrated and move the crosshairs as the launcher is rotated, only while the reaim phase is initiated.

In routine operation and with reference to FIGS. 1 and 2, prior to launch the crosshairs of the telescope optics 20 are placed on the target before the missile is launched. The launch trigger (not shown) is squeezed, launching the missile and sending elevation and azimuth commands from the tracker 10 to the missile, establishing the missile's seeker angular position via the fiber optic link 18. Although the tracker is on the launcher, target tracking is automatic and not affected by subsequent gunner or launcher motions unless the operator desires to interrupt and regain operator control of track by again depressing trigger 16.

Figure 3:
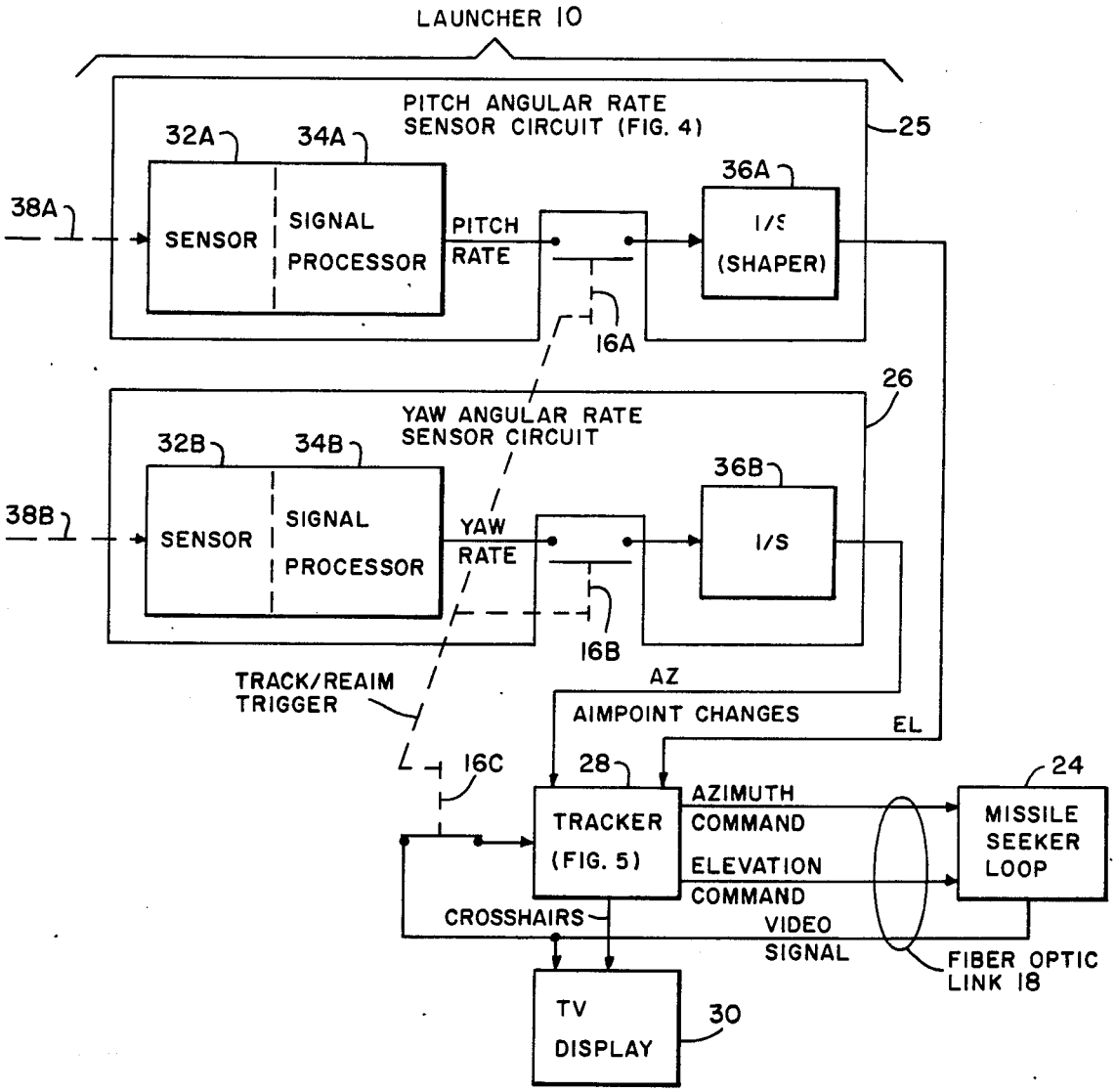
FIG. 3 is a block diagram showing schematically the mechanization of the system after launch of a missile toward a target.

FIG. 3 is a block diagram showing schematically how the fiber optic guidance method is mechanized after launch. Referring to FIGS. 3 and 1, the seeker loop 24 of the missile is coupled by fiber optic link 18 to the launcher 10. In the launcher, sleeve 12 houses angular rate sensor circuits for pitch (elevation) 25 and yaw (azimuth) 26 and the tracker 28. TV display circuit 30, part of the optical package 20 of FIG. 1, is coupled to receive the video signal from fiber optics link 18 and is coupled to receive the crosshairs of the tracking system for superimposing the video image and the crosshairs. Pitch angular rate sensor circuit 25 provides substantially the same function as yaw circuit 26. They each contain an angular rate sensor 32, such as a piezoelectric crystal and related signal processor circuitry 34 for amplifying the signal and a shaping circuit 36 for subsequently processing the respective output elevation and azimuth signals before these signals are coupled to the tracker 28. Launcher angular motions represented by dashed arrows 38A and 38B are sensed by the respective sensors 32A and 32B and subsequently processed. Trigger switch 16 (FIG. 1) is shown as mechanically ganged switches 16A, 16B, and 16C that operate simultaneously, with switches 16A and 16B closing or opening the signal paths to the respective shapers 36A and 36B and switch 16C simultaneously opening or closing the video signal path from the fiber optic link 18 that is coupled into tracker 28. Output command signals from the tracker 28 are coupled via link 18 to the missile seeker loop 24. While switches 16A-C are shown for simplicity as a simple ganged mechanical switch, it is apparent to those skilled in the art that other switching means is just as feasible, such as electronic switching, and the ganged mechanical switch is merely symbolic of the switching action that occurs.

During normal flight, after launch, multiple switches 16A and 16B are open and switch 16C is closed when the trigger 16 is released or not depressed by the operator. The outputs from the two angular rate sensor circuits, accordingly, are set to or returned to zero for this condition. The tracker, using the input video or infrared (IR) signal from the seeker, keeps the crosshairs on the target or some feature in the target area by established means, such as correlation or optical contrast tracking. If the crosshairs are someway directed off the seeker axis, azimuth and/or elevation corrections are sent to the seeker loop. A single fiber optic link is used for both the video link from the on-board missile seeker to the tracker on the ground and for commands from the tracker to the missile to control the seeker from the launcher. The seeker scene with the crosshairs superimposed is displayed to the gunner on the TV attached to the launcher.

When the operator activates the interrupt switch, 16, A and B are closed and C is opened. Now the two integrating ciruits (shapers 36) begin to generate voltages proportional to any subsequent launcher angular motions. The tracker then uses these voltages to bias the crosshairs to a new tracking point. The seeker continues to follow the tracker output and the TV display still shows the seeker scene with the crosshairs superimposed. When the operator deactivates the interrupt switch 16; A, B, and C return to the normal position and the tracker begins tracking the new aimpoint established by the repositioned crosshairs via the incoming video signal.

Figure 4:
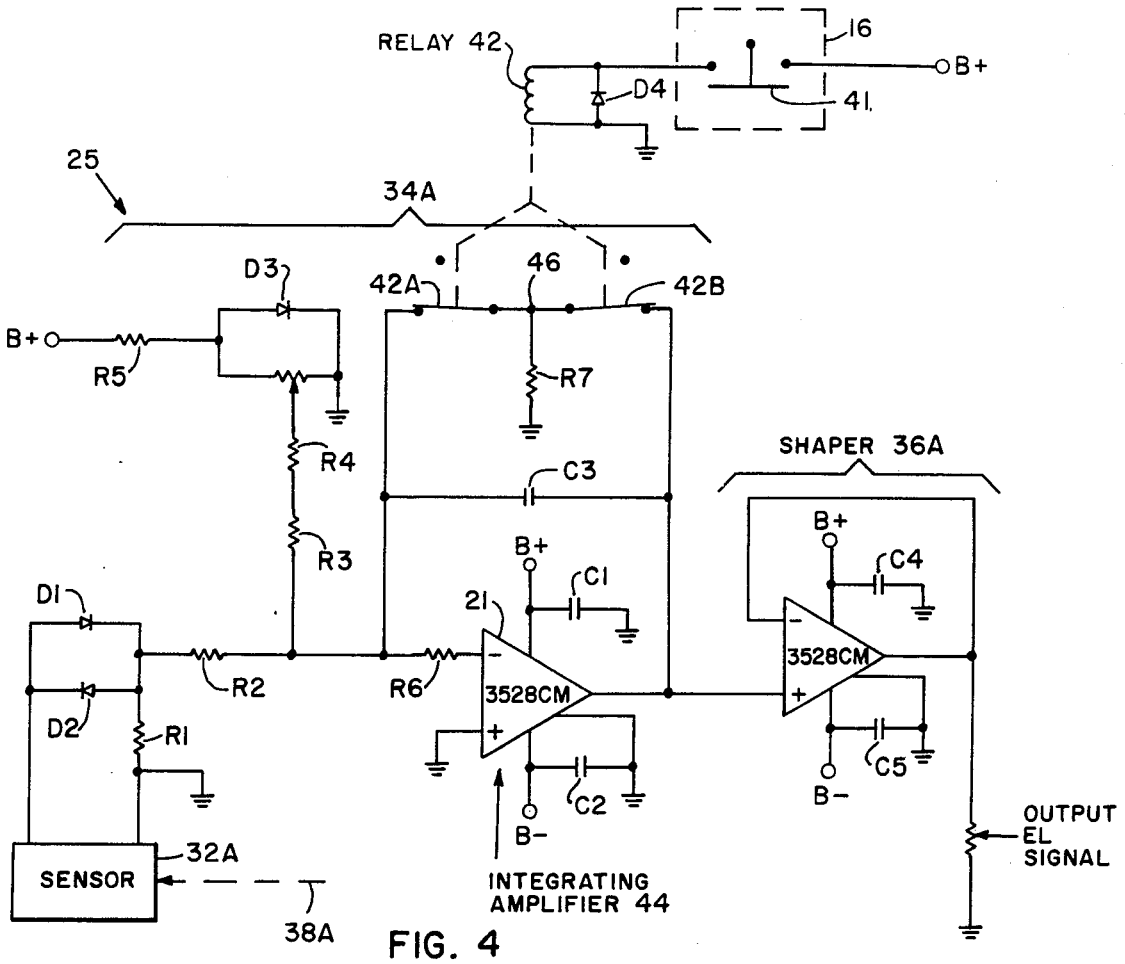
FIG. 4 is a simplified schematic of pitch angular rate sensors circuitry for FIG. 3.

FIG. 4 shows the pitch channel 25 of the rate sensor signal processing circuitry. Since both the azimuth and elevation channels are basically the same, only the elevation channel is shown. FIG. 4 is a basic schematic of rate signal processing circuitry. Sensor 32A responds to angular rate changes to provide an electrical input to processor 34A. As shown in FIG. 4, the simple and symbolic mechanical switch 16A of FIG. 3 is replaced with a relay operated switching action. Thus, when the operator activates trigger 16, a contact 41 is closed between B+ and a relay 42 to activate the switching or on-off action. When switch 16 is unactivated contact 41 is open (normal operation), relay 42 is de-energized and relay contacts 42A and 42B are closed. This causes an integrating amplifier 44 to provide a zero output regardless of the input. When relay 42 is activated by closure of contact 41, the short circuit path 46 around the amplifier 44 is removed and the incoming rate signal is integrated. Further signal processing is provided by the shaper 36A, after which, the elevation aimpoint command is coupled to tracker 28. The input from angular rate sensor 32A is a voltage proportional to the launcher angular rate of motion in the elevation plane. As long as relay 42 is in its normal (as shown) position the output of the integrating amplifier 44 remains zero. When relay 42 is energized by switch 16 the output amplifier 44 begins integrating the rate input. This signal is further shaped by shaper 36A and sent to the tracker.

Tracking can be mechanized with any type of tracker algorithm. Although a correlation tracker might be used a Southern Research Institute contrast tracker has been used and is set forth generally hereinbelow.

Figure 5:
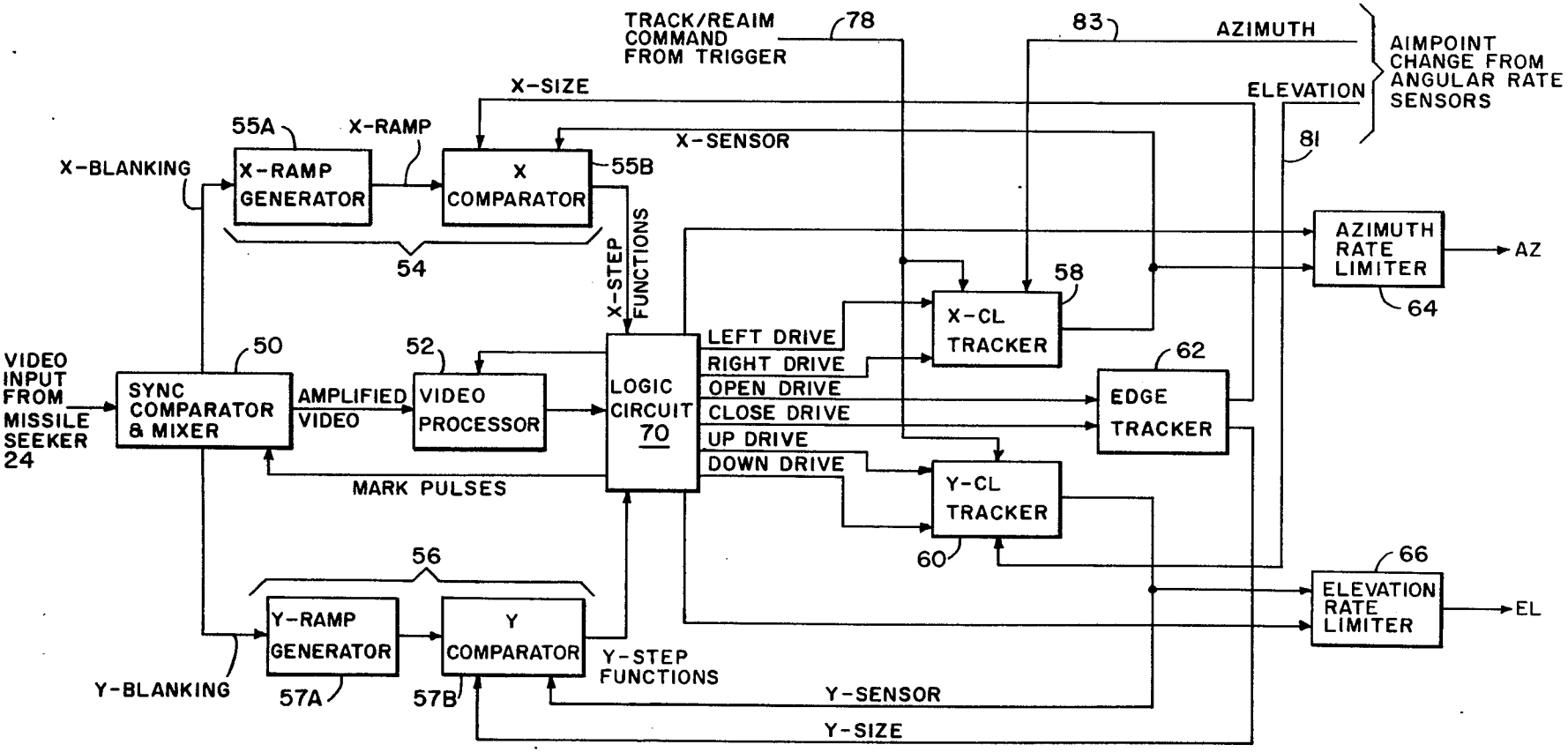
FIG. 5 is a block diagram of a typical television (TV) tracker circuit for FIG. 3.

There are six main sections of the TV contrast tracker as indicated in FIG. 5—video sync separator/mixer 50, video processor 52, tracking gate generators 54 and 56, centerline trackers 58 and 60, size tracker 62, and servo controller/rate limiters 64 and 66.

The sync separator and mixer functions are to separate the horizontal and vertical synchronizing signals from the input video signal, to provide an active area within the field of view for tracking purposes (Y Blank, X Blank), and to superimpose gate marks on the input video so that an operator can monitor the system's performance. The output video, with gate marks, from sync separater and mixer 50 is coupled to video processor 52. The X-blanking and Y-blanking signals are coupled respectively to an X-ramp generator 55A and Y-ramp generator 57A for tracking gate signal generation.

Video processor 52 digitizes the amplified input video in the field of view into a binary signal. All video greater than an adaptive threshold level is digitized as a "true" or "1". The analog signals below this level are digitized as "0" and are considered background information. Either bright or dark targets can be detected by the circuits by simply selecting the mode of emphasis desired.

The principal function of the video processor is to convert the linear brightness of the video signal received into a logic signal which has a positive value when the scanning beam crosses the target image. As the seeker's camera scene changes, both target brightness and background brightness can vary, resulting in positive contrast or negative contrast. The operator may select the contrast polarity for the best detection of the target. When a tracking gate is placed on the target, the magnitude of the contrast signal between a target and surrounding background is detected, and a threshold automatically sets at a fraction, approximately one-half, of the contrast signal. Thus, the system automatically adjusts the detection threshold over a wide range of target and scene contrast.

In the TV tracker, an electronic window or tracking gate is generated by generators 54 and 56 and is timed with respect to the TV scanning raster. The basic system for generating edges of the window consists of vertical and horizontal ramp generators 55A and 57A, synchronized with the composite video, and an array of amplitude comparators, 55B and 57B for each channel, which produce step outputs when the ramps cross their respective thresholds. The comparators step signals are combined logically in logic circuit 70 to form a series of pulses of the desired width and number corresponding to the comparator thresholds. In this adaptive gate tracker, five thresholds are used in both azimuth and elevation time bases, to form an outer window, an inner window, and 2 centerlines, from which left and right half-windows and upper and lower half-windows are formed. These are the tracking "gates." A network of adding amplifiers coordinates the threshold voltages such that the outer window is a constant ratio greater than the inner window. The main or centerline trackers seek to place the outer window on the centroid of the target, and the "size" trackers tend to fit the areas between the outer and inner windows to the boundaries of the detected target area. Elements of the windows are used in the processor, as noted above.

The digital outputs of the respective comparators 55B and 57B and of video processor 52 are logically combined in logic circuit 70 for subsequently providing tracking signals to centerline trackers 58 and 60 and size tracker 62.

The X comparators convert d-c voltage to spatial gates within the field of view. Operational amplifiers within the comparators reference the half gate size voltage to the centerline or centroid position of the target. The resulting voltages are applied to comparators along with a sawtooth wavefrom, (X ramp). The comparator outputs are cross-gated to yield the spatial gating signals required by the tracking logic boards. The Y comparators, are virtually identical to the X comparators except that the gates generated are in the Y or elevation axis.

The centerline tracker (trackers 58 and 60) determines the position-indicating voltage of a centerline comparator (not shown) that best divides the detected target pulses. In the circuit two switch drivers, two switches and an integrator form the main elements of the tracker. In addition, there is a sample-and-hold stage to open the loop during the tracking window. The track/reaim switching of switch 16C takes place in the centerline tracker (shown functionally in FIG. 3). Also, the azimuth and elevation change angle signals for aimpoint changes from the angular rate sensors are coupled to these trackers.

Figure 6:
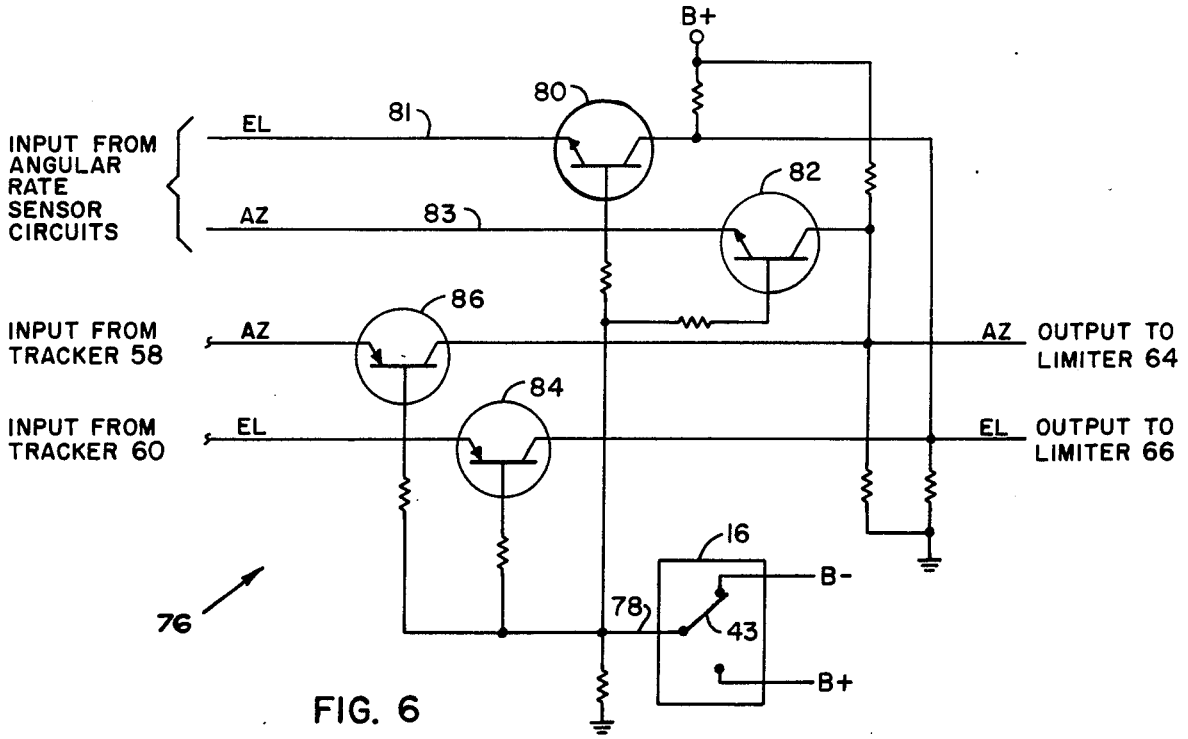
FIG. 6 is a simplified schematic of an electronic switching circuit for providing azimuth and elevation aimpoint changes during tracker reaim.

Switching by the tracker between the seeker originated guidance signals and the track/reaim originated guidance signals is routine electronic switching and may be similar to that shown in FIG. 4. Alternatively to the relay switching action of FIG. 4, the tracker azimuth and elevation signals may be switched as shown in FIG. 6. In FIG. 6, the simple and symbolic mechanical switch 16C of FIG. 3 is replaced by electronic switching circuit 76. Therefore, when the operator of the launcher activates switching trigger 16 a contact 43 of the trigger couples a B+ signal via lead 78 to electronic switches through which the azimuth and elevation signals must pass. Typically, an NPN transistor switch 80 is coupled via lead 81 to receive the elevation aimpoint change from angular rate sensor circuit 25 (FIG. 3). Similarly, an NPN transistor 82 is coupled via lead 83 to circuit 26 to receive the azimuth input. When contact 43 is open the transmiter circuits are open, preventing signals from passing through the transistors. In a similar manner, the elevation signal developed in tracker 60 (FIG. 5) is coupled to a PNP transistor 84 and the azimuth signal developed in tracker 58 is coupled to a PNP transistor 86. When contact 43 is open the transistors 84 and 86 are enabled, allowing the azimuth and elevation signals from the processed video to provide command output signals to respective limiters 64 and 66 (FIG. 5). When contact 43 is closed, transisters 80 and 82 are enabled to provide the output signals from the angular rate sensors and transistors 84 and 86 are disenabled.

The circuitry of FIG. 6 is a typical switching circuit shown in simplified form. In mechanically housing the circuit it can be placed in a separate housing or circuit board and have electrical connections coupled between the related input-output components—trigger 16, sensor circuits 25 and 26, trackers 58 and 60, and limiters 64 and 66. However, as shown in FIG. 5 there is no block diagram isolating this switching action since the several components are dispersed into the tracker circuits 58 and 60. Thus, the electronic switching represented by transistor switches 80 and 84 and their related biasing circuitry are in tracker 60. Similarly, the electronic circuitry represented by switches 82 and 86 are in tracker 58.

In the centerline trackers, the switch drivers provide left and right half gates in the X axis and upper and lower half gates in the Y axis; digitized video is applied to all half gates. The resulting logic signals close switches in the input network of an adding integrator, applying current pulses whose amplitudes vary as the reciprocal of the other dimension of the window. For example, for the Y tracker, the current must be proportional to $1/x_{sum}$. Two auxiliary regulating loops maintain the above relations as target size varies.

The centerline tracker also includes a sample-and-hold buffer, to keep the dynamic tracking signals from appearing in the position outputs. During the tracking window, the output of the integrator is disconnected from a holding capacitor. At the bottom of the window, the holding capacitor is reconnected to the integrator and accepts the new position voltage. The change in this voltage can be any chosen fraction of the tracking error from a small value to a maximum of 2. The correction fraction is called the "gain." Values greater than 1 cause oscillation of the loop and low values result in slow tracking but good noise filtering. The output stage also contains a network to develop a ramp proportional to the accumulation of prior steps, thus reducing the error for a constant velocity input. This function is called a rate memory, or "coasting," and the gain in the direct tracker can be reduced in proportion to the gain in the coasting network. An optimum time constant can be utilized for the rate memory according to particular acceleration requirements of the main optical tracking system and acceleration capabilities of targets.

The size tracker 62 functions to maintain the outer and inner windows bracketing the periphery of the target. This proivdes the tracker 28 with the uniqueness of an adaptive gate tracker. Size trackers 62 are spatially referenced to the centerline trackers. Tracking errors are derived by sampling the digitized video at the edges of the sampling gates. The edges of the gates are positioned to satisfy a fixed ratio of target to background time.

Automatic rate limiters 64 and 66 provide limited rate commands based on target size and gate-target overlap when the errors of the seeker are such as to move the tracker target toward the null or zero position.

The missile seeker loop 24 is not shown and is typical of video seekers using cameras that can be remotely positioned on a desirable scene. The seeker located in the missile utilizes a vidicon such as a Sony model 3250 television camera with an S-11 photocathode mounted on a two-axis rate stabilized gimbal. The input to the vidicon is through an optical system comprising a gimbal-mounted lens and a body-mounted dome. The combined field of view is 6.5 degrees, and the system focal length is 3 inches with a relative aperture of about f/7. The gimbal is trainable ±15 degrees in azimuth and elevation. The optical system is fixed in focus at infinity. Two rate integrating gyros are located on the gimbal and used to sense the rates of the gimbal in the two axes. A position feedback potentiometer is coupled to each gyro axis to sense the missile body to gimbal axis angle. Torque motors are used on each axis for alignment control.

The principal function of the seeker is to measure the true line of sight rate between the missile and the selected target. There are three servo loops for both azimuth and elevation used in the seeker head to accomplish this function—a rate integrating gyro gimbal loop, the TV tracker target position error detector loop discussed earlier, and the TV camera gimbal loop.

In a rate integrating gyro, the rotor axis is normal to the gyro body and its bearings are in a gimbal whose axis is parallel to the body. When the gyro body is rotated about the axis mutually perpendicular to the above two axes, the gyro will precess and rotate its gimbal in the housing such that the gimbal angle is the integral of the input angular rate with respect to time.

In the gyro gimbal loop, operation is to sense the gimbal rotation with a pick-up excited at a predetermined frequency, such as 4800 Hz, and to apply torque to the gimbal to oppose the precession as completely as possible. The torquer current is then a very close measure of the angular rate of the input motion of the gyro case, and the response time is about 1 millisecond.

The rate gyros measure the azimuth and elevation angular rates of the camera gimbal. Potentiometers are coupled to the gimbals to measure the angles between the gimbals and the missile body for caging purposes. The rate signal is subtracted from the sum of all d-c input signals and the difference is shaped and amplified to excite the torque motors.

As shown in FIG. 2, the operational sequence is for lock-on-before-launch. However, due to the reaim capability of interrupt switch 16, capability of firing or launching a missile from concealment and/or of firing against a target in defilade is added by providing a lock-on-after-launch mode. In lock-on-after-launch the target need not be visible to the operator prior to launch and the launch may actually be directed away from the desired target to overcome an obstacle such as a building, a wall, or a clump of trees and may subsequently be redirected toward the target by depressing the switch 16 and moving the launcher to provide tracking signals so as to direct the seeker to the desired target. It is not necessary to point the launcher toward the target. It is only necessary for the operator to move the launcher in the proper relative direction. For example, assuming a target is present at ground level, if the missile is lanched upward at an angle of 60 degrees from ground level, to reacquire control the operator needs only to depress switch 16 and move the tracker in a relative direction that tells the missile the direction desired until a target is brought into view via the missile seeker. The operator views the video scene transmitted from the missile during this time and merely moves the launcher in the direction that positions or brings a target into the zero or crosspoint of the crosshairs.

The gunner can take cover immediately after missile launch and still observe the scene and control the missile via the TV. Terminal aimpoint refinement capability allows reduced resolution requirements for the seeker, since the target need not be clearly resolved at launch and through enablement of the operator or gunner to choose and lock on to a more vulnerable impact point as the missile closes and target feature resolution improves.

Additionally, the gunner can observe missile flight and relock the seeker on the target in the case of temporary obscuration or countermeasures. The gunner can fire against targets whose contrast is too poor to permit seeker lock on at all, or to lock on to a desired target feature, by delaying lock on until the missile is closer to the target.

Target selectivity via switch 16 allows abort if the target is identified as friendly during the terminal portion of a flight, since improved terminal resolution allows positive identification. This also allows the weapon to be used in mixed engagements where friendly armor is involved.

When lockon is achieved before launch, the system operates as a fire-and-forget system unless the operator chooses to intervene, such as, by controlling the end-game.

While the invention has been described with certain specific embodiments thereof, it will be understood that other modifications will suggest themselves to those skilled in the art and that it is intended to cover such modifications that fall within the scope of the claims appended hereto.

For example, the switching circuit 76 is only typical of numerous video signal switching circuits. A simple alternative switching can also be provided by other high speed analog switching circuits such as a Siliconix DG184 analog switch. A single DG184 provides double pole-single throw switching via junction-type field-effect transistors (JFET) in two channels with high speed drivers to control the ON-OFF state of each switch. An inverter coupled to the input of one driver allows the two drivers to be enabled via a common trigger input, such that one dirver is ON when the other is OFF and vice versa.

We claim:

1. In a missile system wherein a missile is launched from a movable housing and directed toward a target, a missile guidance method comprising the steps of:

launching a missile along a selectable path, generating azimuth and elevation guidance commands for said missile at a tracker station on said movable housing, guiding said guidance commands along a confined optical path from the tracker station to the missile, optically imaging a selectable field of view along and adjacent to said path ahead of said missile, guiding a video signal of said optical imaging from said missile to said tracker station along said confined optical path for providing selectable missile azimuth and elevation guidance signals to the tracker, directing said video signal to a video display on said movable housing for providing a visual image of optically imaged scenes, measuring the angular rate of movement of said movable housing for providing azimuth and elevation signals indicative of changes in direction of movement of said tracker and said video display, coupling the azimuth and elevation signals obtained from the measured angular rate of movement as a selectable input to said tracker station, and controllably switching between said video signal azimuth and elevation input signals to the tracker station and said angular rate azimuth and evaluation input to the tracker station for controlling said generating of azimuth and elevation guidance commands.

2. A method of missile guidance as set forth in claim 1 and further comprising the steps of:

selecting said angular rate azimuth and elevation input to the tracker station during the step of controllably switching, and selectably moving said housing to generate a desired change in azimuth and elevation signals for changing the azimuth and elevation guidance commands and thereby changing said optically imaged, selectable field-of-view.

3. A method of missile guidance as set forth in claim 1 and further comprising the steps of: measuring the angular rate of movement of the movable housing by continuously sensing the movable platform angular motion, providing variable electrical signal outputs in response to said sensing, and integrating and shaping said electrical signal outputs to provide azimuth and elevation signals to the tracker station only in response to switching by said step of controllably switching said angular rate input to the tracker.

4. In a missile system wherein a missile having a video imaging seeker for scanning a selectable look angle is launched from a portable launcher comprising a launch tube, a missile tracker, a video display, a switching circuit for controlling the source of missile guidance commands, and angular rate sensors all supported on said portable launcher; a missile guidance method comprising the steps of:

aiming and launching a missile from said launch tube along a selectable path, directing azimuth and elevation guidance signals from said angular rate sensors to said tracker, transmitting azimuth and elevation guidance commands from said tracker to said missile during and after launching of said missile, optically imaging a video image signal from said imaging seeker in said video display of visual scenes ahead of said missile seeker, confining said azimuth and elevation commands directed from the tracker to the missile and said video image signal to a common, meandering optical path between said tracker and said missile, coupling said video image signal to said tracker, processing said video image signal by said tracker to derive missile azimuth and elevation guidance signals indicative of missile trajectory coordinates and sensor look angle, and releasably switching between the azimuth and elevation guidance signals from said angular rate sensors and the derived azimuth and elevation signals for providing alternatively selectable azimuth and elevation guidance commands.

5. A missile guidance method as set forth in claim 4 wherein said step of releasably switching for providing alternatively selectable azimuth and elevation guidance commands further comprises the steps of:

activating said switching circuit to activate said guidance commands from said angular rate sensors and to suppress said derived guidance signals, and deactivating said switching circuit to deactivate said guidance commands from said angular rate sensors and to activate said derived guidance signals.

6. In a missile system wherein a missile is launched from a portable launcher, the improvement of a missile guidance system comprising: a tracker mounted on said portable launcher, a fiber optic link coupled between said missile and said tracker for coupling tracking commands to and video signals from said missile, said tracker receiving said video signals and providing azimuth and elevation commands in response to said video signals, a television display mounted on said launcher and being further coupled to receive said video signals for displaying a video image from said missile on said display, angular rate sensing means mounted on said portable launcher for sensing angular motion of said launcher, and signal processing means coupled between said sensing means and said tracker for providing signals indicative of launcher azimuth and elevation aimpoint changes to said tracker.

7. A missile guidance system as set forth in claim 6 and further comprising switching means coupled to said tracker for controlling passage of said video signals through said tracker, and said switching means being further coupled to said signal processing means for controlling passage of said signals indicative of launcher azimuth and elevation aimpoint changes through said processing means.

8. A missile guidance system as set forth in claim 7 wherein said switching means has first and second operating states, said first state allows said video signal derived azimuth and elevation signals to be coupled as command outputs from said tracker for automatic guidance of said missile, and said switching means, when in said second state, suppresses video signal processing and activates processing of said signals indicative of launcher azimuth and elevation aimpoint changes as a command output.

9. A missile guidance system as set forth in claim 6 wherein said missile has a seeker therein for measuring the line-of-sight rate along a missile look angle, said missile seeker providing said video signals for coupling to said tracker and television display, and said tracker responding to said video signal input to generate azimuth and elevation commands for directing the missile flight path along the look angle.

* * * * *